US006216381B1

(12) United States Patent
Strand

(10) Patent No.: US 6,216,381 B1
(45) Date of Patent: Apr. 17, 2001

(54) LASER DEVICE FOR USE IN ADJUSTING A FIREARM'S SIGHT AND A METHOD FOR ALIGNING A LASER MODULE

(76) Inventor: Jan Strand, 1019 E. Mountain Sage, Phoenix, AZ (US) 85048

( * ) Notice: Subject to any disclaimer, the term of this patent is extended or adjusted under 35 U.S.C. 154(b) by 0 days.

(21) Appl. No.: 09/317,586

(22) Filed: May 24, 1999

(51) Int. Cl.[7] ..... F41G 1/34
(52) U.S. Cl. ..... 42/103
(58) Field of Search ..... 33/233, 234, 228; D22/109; D16/132; 356/247, 153; 362/110; 42/103

(56) References Cited

U.S. PATENT DOCUMENTS

| | | | | |
|---|---|---|---|---|
| 3,782,832 | | 1/1974 | Hacskaylo | 356/153 |
| 4,481,561 | * | 11/1984 | Lanning | 362/111 |
| 4,530,162 | | 7/1985 | Forrest et al. | 33/228 |
| 4,761,907 | * | 8/1988 | De Bernardini | 42/106 |
| 4,825,258 | * | 4/1989 | Whitson | 356/153 |
| 4,830,617 | * | 5/1989 | Hancox et al. | 434/21 |
| 4,879,814 | * | 11/1989 | Wallace et al. | 33/234 |
| 5,001,836 | | 3/1991 | Cameron et al. | 33/234 |
| 5,241,458 | * | 8/1993 | Abbas | 362/110 |
| 5,351,429 | | 10/1994 | Ford | 42/103 |
| 5,365,669 | * | 11/1994 | Rustick et al. | 33/234 |
| 5,432,598 | | 7/1995 | Szatkowski | 356/153 |
| 5,446,535 | | 8/1995 | Williams | 356/153 |
| 5,454,168 | | 10/1995 | Langner | 33/234 |
| 5,488,795 | * | 2/1996 | Sweat | 42/103 |
| 5,531,040 | | 7/1996 | Moore | 42/103 |
| 5,685,106 | * | 11/1997 | Shoham | 42/103 |
| 5,787,631 | * | 8/1998 | Kendall | 42/103 |
| 5,909,951 | * | 6/1999 | Johnson et al. | 362/111 |
| 6,068,484 | * | 5/2000 | O'Loughlin et al. | 434/22 |

* cited by examiner

*Primary Examiner*—Michael J. Carone
*Assistant Examiner*—Troy Chambers
(74) *Attorney, Agent, or Firm*—Quarles & Brady Stareich Lang, LLP

(57) ABSTRACT

A device facilitates adjustment of a sight of a firearm by providing a visible mark on a target when the device is placed within a chamber of the firearm. The device may include a laser module energizeable within the chamber to produce the mark at a position along a laser axis, a power supply situated within the chamber to energize the laser module when an electrically conductive flowpath is completed with the laser module, and an electrical circuit including a conductive part of the firearm through which electrical current flows to complete the flowpath. A method of laser module alignment is also demonstrated involving rotation of and limited linear motion of the laser module.

20 Claims, 2 Drawing Sheets

LASER DEVICE FOR USE IN ADJUSTING A FIREARM'S SIGHT AND A METHOD FOR ALIGNING A LASER MODULE

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates to devices and techniques for accurately positioning the sight of a firearm, and more particularly deals with in-bore laser devices and methods of using such devices to improve the positioning accuracy of a firearm's sight.

Use of sights for aiming firearms, such as rifles and pistols, is well known. Ideally, when a firearm's scope is properly adjusted, the projectile shot from the firearm will strike the target at a known position identified through visual alignment with a feature of the scope, such as the intersection of scope cross-hairs. Understandably then, those with skill in the art desire efficient techniques for accurately positioning a firearm's sight.

U.S. Pat. No. 5,787,631 ("'631 patent") issued to Kendall discloses an array of prior techniques for use in aligning firearm sights. For example, the '631 patent discloses a technique in which a series of rounds are shot at a target, each followed by comparison between the anticipated target spot as viewed through the sight and the corresponding actual striking location for the given round. The comparisons were used to refine the position of the firearm sight. Presumably, this "trial and error" approach is time consuming, and wastes ammunition.

The '631 patent also discloses a group of laser-based techniques for aligning a firearm sight, and in particular, focuses on U.S. Pat. No. 5,365,669 ("'669 patent") issued to Rustick et al. The '631 patent identifies a problem with the '699 patent approach, and proposes a solution therefor. Specifically, one of the main problems associated with the '699 patent was that the laser beam emitted from the laser module would likely fail to clear the bore of the rifle, unless suitable laser alignment was provided.

In response, the '631 patent proposed using set screws to facilitate laser module alignment. Specifically, the '631 patent disclosed a housing including a threadedly engaged inner sleeve, which contains a laser module and a battery. Four set screws penetrate the housing to facilitate movement of the laser module, presumably into a properly aligned position. Additionally, the '631 patent discloses the use of a springbased switch mechanism to operate the laser module. Specifically, when the '631 device is inserted into a firearm and the firearm's bolt is engaged, the force of the bolt closes the switch mechanism to activate the laser module.

Though the '631 patent asserts to have overcome certain shortcomings of the prior art, it too has limitations. For example, using four set screws to align the laser module is a cumbersome and time consuming task. Each time the user makes an adjustment, one set screw is tightened, and an opposing set screw must be loosened to permit free motion for the laser module. Moreover, with each adjustment of the laser module, the user has to evaluate its effectiveness in planning the next adjustment. The process is inherently complex, as it involves coordinated adjustments along multiple axes of motion for the laser module.

Another problem affiliated with the '631 patent resides in the switch mechanism. Pressing the switch 8 at that back of the '631 device energizes the laser module. This can be carried out when the device is loaded into a firearm, as desired, due to the force of the firearm's engaged bolt. Similarly, the laser module can be activated when the '631 device is out of the firearm, as pressing switch 8 energizes the laser module regardless of whether the device is or is not located within the firearm. Thus, a user can prematurely drain the device's battery by inadvertently closing switch 8 by, for example, putting the device in a coat pocket. Switch 8 poses yet another problem, namely, that it incorporates movable components subject to eventual inoperability due to normal wear and tear.

There therefore was a need for an improved laser device for use in adjusting a firearm's sight, and a method for aligning a laser module that overcome the limitations of prior devices and techniques.

BRIEF SUMMARY OF THE INVENTION

The present invention concerns a device facilitating adjustment of a sight of a firearm by providing a visible mark on a target when the device is placed within a chamber of the firearm. The device may include: a laser module energizeable within the chamber to produce the mark at a position along a laser axis; a power supply situated within the chamber to energize the laser module when an electrically conductive flowpath is completed with the laser module; and an electrical circuit including a conductive part of the firearm through which electrical current flows to complete the flowpath.

In this manner, inadvertent operation of the device is averted, as part of the conductive flowpath for energizing the laser module is a portion of the firearm. To further this end, a non-conductive cover or a carrier with an appropriately situated non-conductive region may be used to prevent unintentional operation when the device is outside the firearm.

Similarly, a method is disclosed which prevents unintentional operation of the device. The method involves positioning the laser module within a chamber of a firearm; and adjusting the firearm to complete an electrical circuit between a power supply and the laser module, wherein part of the firearm conducts current in between the power supply and the laser module.

The device may also include a housing having an internal cavity, which restricts the laser module's range of motion to rotation of the module about a laser axis, and a sweeping motion of the module defining a locus of points along the laser axis which comprises a single plane. The range of motion restriction on the laser module facilitates a more simplified alignment process for the laser module, whether it be used to calibrate a gun sight or not.

The method of aligning a laser module having a laser axis involves: providing a housing including an internal cavity; inserting the laser module into the internal cavity, which restricts the laser module's range of motion to rotation of the module about the laser axis, and a sweeping motion of the module defining a locus of points along the laser axis which comprises a single plane; supporting the housing containing the laser module; energizing the laser module to produce a mark on a target; holding the housing in place while rotating the laser module about the laser axis until the mark strikes an axis on the target that is coplanar with the single plane; and moving the laser module until the mark strikes a desired position.

The and other objects, advantages and aspects of the invention will become apparent from the following description. In the description, reference is made to the accompanying drawings which form a part hereof, and in which there is shown a preferred embodiment of the invention. Such embodiment does not necessarily represent the full scope of the invention and reference is made therefor, to the claims herein for interpreting the scope of the invention.

DETAILED DESCRIPTION OF THE INVENTION

Figure 7:
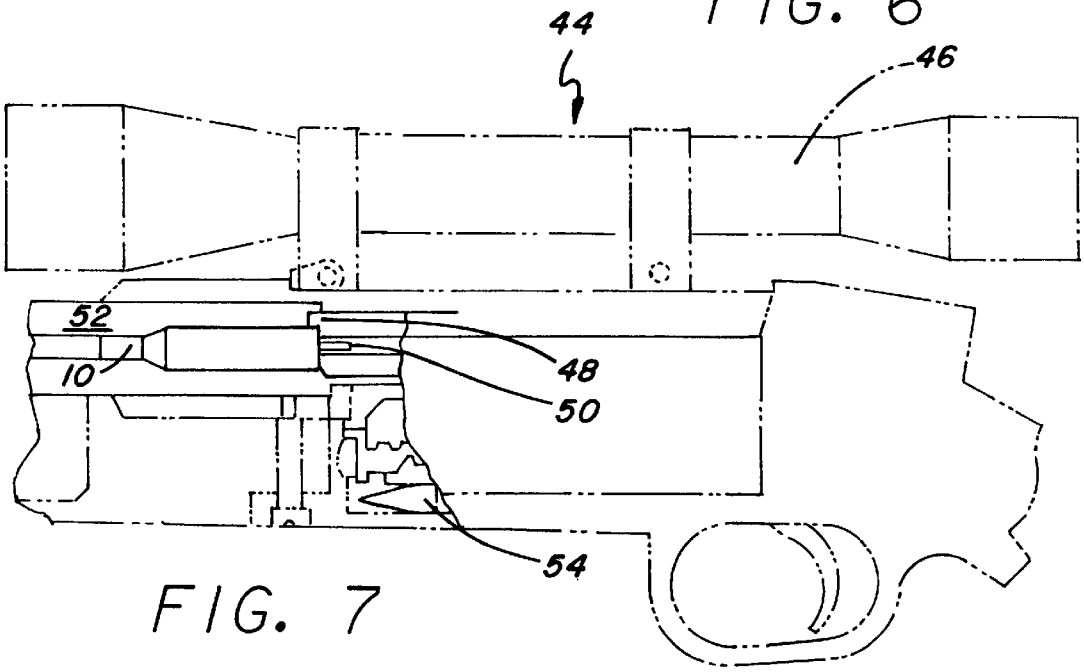
FIG. 7 is a partial perspective view of a firearm and scope with portions broken away to show the device of FIG. 2.

Referring now to the drawings, wherein like reference characters represent corresponding elements throughout the several views, and more specifically referring to FIG. 7, device 10 of the present invention is shown within firearm 44.

Firearm 44 is shown in the "locked and loaded" condition, a state well known to those skilled in the art. Portions of FIG. 7 are shown broken away to reveal firearm internals including a bolt head 48, a firing pin 50, and a barrel 52. Device 10 is situated within a chamber of firearm 44 where a round typically resides prior to firing, though device 10 cannot be fired. Additionally, one of several reserve rounds 54 is also shown, but typically no actual rounds 54 are loaded when device 10 is being used to facilitate sight adjustment.

Here, firearm 44 is a rifle, though those skilled in the art understand that device and its associated methodology could be used with any type of firearm including a rifle, a hand gun, a machine gun, or the like. Similarly, firearm 44 includes a scope 46, but those skilled in the art understand the device 10 and the related methodology could be used with any type of firearm scope, sight, or the like.

Figure 2:
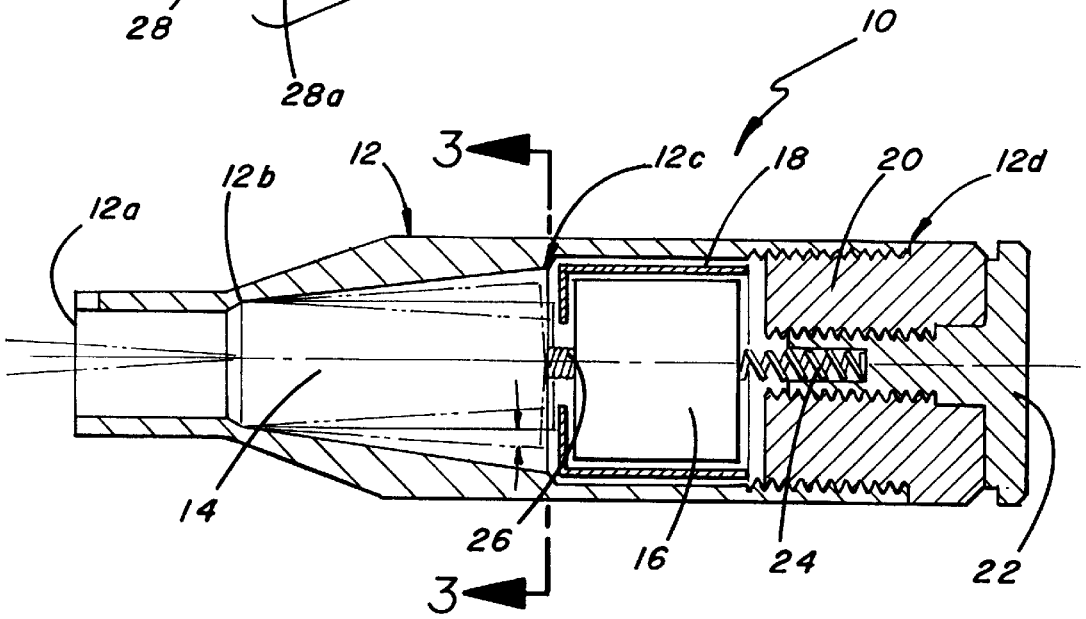
FIG. 2 is a diametric cross-sectional view of the device of the present invention.

Referring to FIG. 2, device 10 includes housing 12 containing laser module 14 and power supply 16. The external shape of device 10 resembles the external shape of round 54 (see FIG. 7), though unlike round 54, device 10 does not contain a bullet. More generally, the external shape of device 10 will resemble the external shape of a round of appropriate caliber for shooting from the firearm, whatever be the caliber and type of the firearm, though device 10 typically will not include a bullet.

By way of example, the external configuration of housing 12 comprises various sections from front to back. A front tubular section extends from front opening 12*a* to position 12*b*. From position 12*b* to a location in between locations 12*b* and 12*c*, the outer diameter of housing 12 increases providing a conically-shaped section. At a point in between locations 12*b* and 12*c*, the increase in outer diameter of the conically-shaped section stops, and a tubular section having a very slight (not visible in FIG. 2) increase in outer diameter extends to the back end 12*d* of housing 12.

Front-end opening 12*a* permits laser beam passage, while the opposite end of housing 12 also includes an opening, typically closed when device 10 is assembled. More specifically, a back-end insulator 20 is threadedly engaged with housing 12. Back-end insulator 20 is tubular and includes a central cavity with internal threads for receiving back-end cap 22, which has a T-shaped cross-section. The shaft of back-end cap 22 includes a recess for receiving a spring 24, which makes contact with power supply 16 when device 10 is assembled.

Housing 12, back-end insulator 20, and back-end cap 22 are each manufactured using well known techniques. The material used to make housing 12 and back-end cap 22 is brass, or any other rigid conductive material; however, back-end insulator 20 is made with a rigid material that is, at least in part, non-conductive. For example, back-end insulator 20 may be entirely made from non-conductive material, like plastic. Alternatively, back-end insulator 20 may be made from a conductive material, such as aluminum, with an outer layer completely anodized using a non-conductive material. In yet another alternative, insulator 20 may be made with a conductive material having selected outer surface portions anodized with non-conductive material.

In sum, housing 12, back-end cap 22, and spring 24 are conductive, while backend insulator 20 (or at least selected outer surface portions thereof) is non-conductive. Accordingly, an open circuit is established by back-end insulator 20, regardless of its manner of construction, in the electrical flowpath in between power supply 16 and housing 12.

Power supply 16 comprises one or more batteries providing sufficient power to operate laser module 14. Presently, a series pair of button batteries is used providing a combined voltage of 3.0–4.5 volts, though any one of a number of well known power supplies may be used. Moreover, if a different laser module 14 were used (having different power needs), then alternative power supply arrangements may be used.

Power supply 16 makes electrical contact with springs 24 and 26. Specifically, the negative electrode of power supply 16 contacts spring 26, in electric communication with laser module 14, and the positive electrode of power supply 16 contacts spring 24, in electric communication with back-end cap 22. However, backend insulator 20 prevents completion of the flowpath from back-end cap 22 to housing 12, which is in electric communication with laser module 14. Thus, laser module 14 does not operate until an electrically conductive flowpath is established in between back-end cap 22 and housing 12.

When power supply 16 (e.g., button batteries) does not include its own outer insulating layer, insulator 18 is included. This prevents power supply 16 from making direct electrical contact with the interior surface of housing 12 or with laser module 14 (other than through spring 26), which would activate laser module 14. Insulator 18 includes a tubular section, which electrically isolates power supply 16 from the interior surface of housing 12, and a lip inserted in between power supply 16 and laser module 14 for similar purpose. Insulator 18 may be made from plastic or any other rigid insulating material.

The transitional region of insulator 18, between its tubular section and lip, rests against a mechanical stop provided by an inner surface of housing 12 which begins to taper inward at location 12*c*. The mechanical stop prevents contact in between power supply 16 and laser module 14, other than through spring 26. If power supply 16 is itself provided with an outer insulating layer, then use of insulator 18 for electrical isolation would be redundant.

Figure 3:
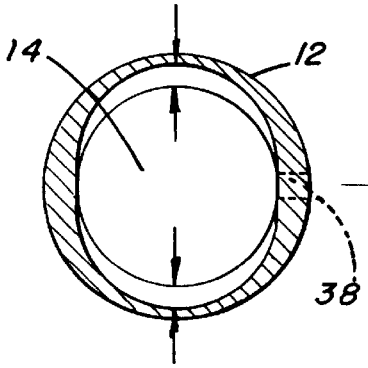
FIG. 3 is a view taken along line 3—3 of FIG. 2, but showing the device in full cross-section.

In between locations 12*c* and 12*b*, the inner diameter of housing 12 is tapered. Moreover, the inner diameter of housing 12 at location 12*b* is such that it provides another mechanical stop, this one for the front edge of laser module 14. FIG. 3 shows how laser module 14 resides within an internal cavity of housing 12. Specifically, opposing outer surfaces of laser module 14 make contact with opposing interior surfaces of housing 12. A cross section of the cavity in FIG. 3 containing laser module 14 is generally elliptical, permitting substantially one axis of motion for laser module 14 within housing 12, namely up and down as viewed in FIG. 3. An aperture 38 is provided through housing 12 permitting access to laser module 14.

Figure 1:
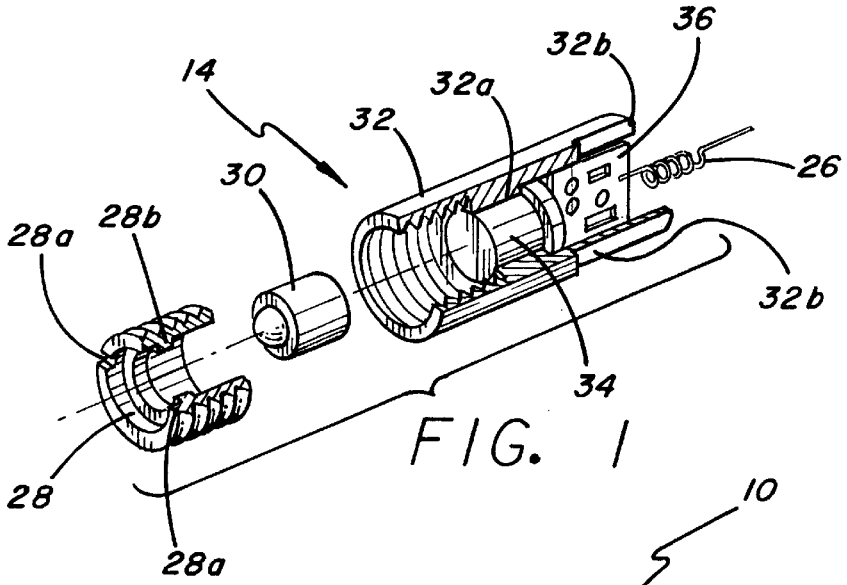
FIG. 1 is a partially exploded perspective view with parts broken away from a laser module for use in the device of FIG. 2.

Referring to FIG. 1, laser module 14 comprises lens holder 28, collimating lens 30, housing 32, laser diode 34, and laser diode driver circuit 36. Lens holder 28 has a generally tubular external shape with a threaded surface. A lip 28*b* is provided on an interior surface of lens holder 28 against which collimating lens 30 rests. A pair of opposing notches 28*a* are provided in a front portion of lens holder 28 for screwing lens holder 28 into matching internal threads of laser module housing 32. Any conventional technique may be used to make lens holder 28 from any rigid material such as brass, steel, plastic, and aluminum. Collimating lens 30 is a commercially available 4 mm diameter plastic lens, though the size of and material used for collimating lens 30 may be altered, if desired.

Laser module housing 32 has a generally tubular external shape, and an internally threaded recess for receiving lens holder 28. Laser module housing 32 also includes a mechanical stop 32*a* for laser diode 34. Laser module housing 32 also includes a pair of opposing notches 32*b* for moving the laser module 14 during alignment Any conventional technique may be used to make laser module housing 32 using any rigid conductive material such as brass. Any commercially available laser diode 34 and driver circuit 36 may be used.

Figure 8:
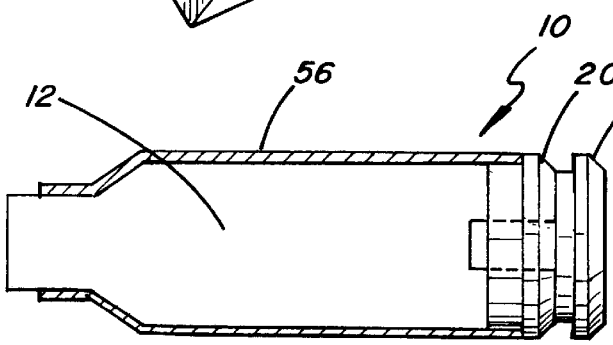
FIG. 8 is a simplified cross-sectional view of the device with an outer sleeve for adjusting the device's outer dimensions to match those required by the firearm.

In FIG. 8, an outer sleeve 56 is shown coupled to device 10. The purpose of outer sleeve 56 is to expand the effective outer dimensions of device 10 such that it may be used with firearms using a round of larger caliber than that for device 10 without the inclusion of outer sleeve 56. Regardless of whether or not outer sleeve 56 is used, the structure and operation of device 10 is as described herein, though outer sleeve 56 is made with a conductive material, such as brass.

Assembly of laser module 14 involves inserting collimating lens 30 into lens holder 28 such that the front edge of lens 30 abuts the interior surface of lip 28*b*. Collimating lens 30 is attached using any commercially available adhesive or adhering technique, such as press fitting. The laser diode 34, driver circuit 36, and spring 26 are typically prefabricated into a combined unit by the manufacturer. The combined unit is inserted and attached to the interior surface of the laser module housing 32 using a commercially available conductive adhesive, taking care to abut the laser diode 34 against mechanical stop 32*a*. The lens holder 28 (and collimating lens 30) are then screwed into the laser module housing 32, making use of the notches 28*a*. The laser diode 34 is energized and the lens holder 28 rotated to focus the laser beam in a well known manner. With the laser module 14 assembled and focused, it may be filled with a commercially available non-conductive epoxy.

Figure 5:
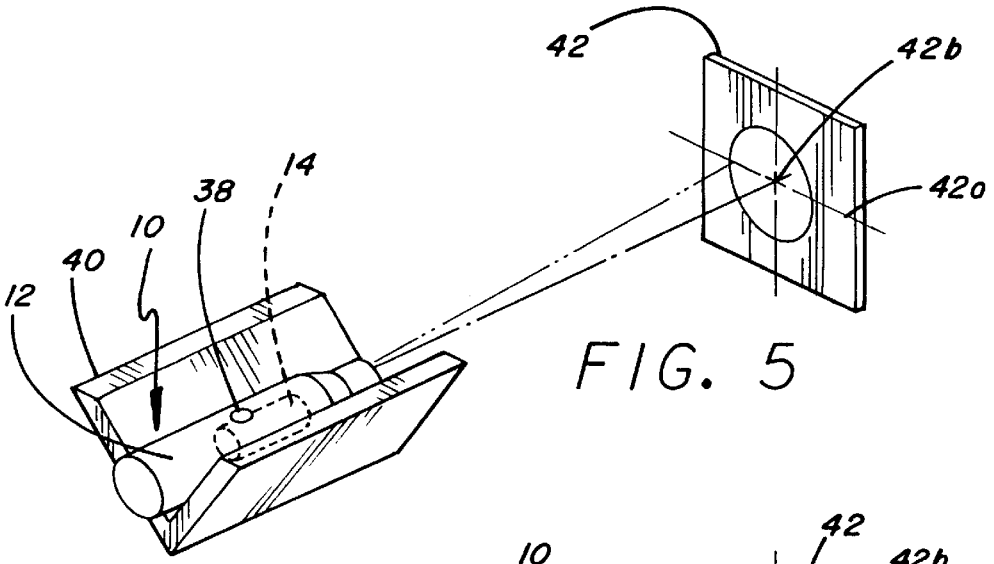
FIG. 5 is a perspective view of the device of the present invention resting in a support, and emitting a laser beam against a target for use in aligning the laser module.

In order to align laser module 14, a target 42 is set up at a desired distance (e.g., 100–200 feet) from support 40, as shown in FIG. 5. Target 42 includes a visible center point 42*b* (e.g., a one-inch diameter target spot) that has been pre-aligned with support 40 in a well known manner. This means that a properly focused and aligned laser module, when energized and placed in support 40, would produce a laser beam spot within the desired visible center point 42*b* of target 42.

Figure 4:
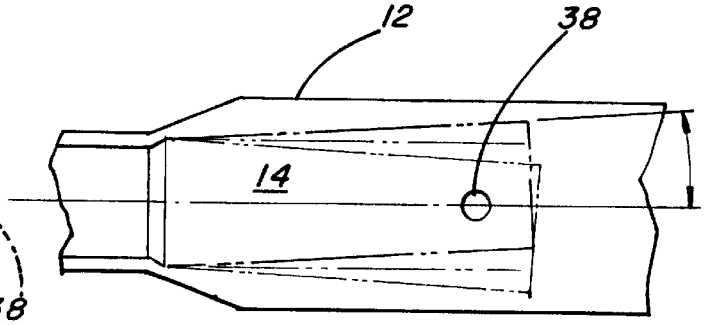
FIG. 4 is a partial plan view of the device of the present invention.

Now, housing 12 is secured in place on support 40 using a clamp, one's own hands, or any other suitable technique such that aperture 38 faces upward, as shown in FIG. 5. The housing's internal cavity is positioned such that when it receives laser module 14, the laser module's range of motion is restricted to two possibilities. First, laser module 14 may be rotated about its own axis (i.e., axial rotation about the laser beam). Second, laser module 14 may be swept in a linear motion, which defines a locus of points along the laser beam axis comprising a single plane. The sweeping linear motion of laser module 14 is depicted in the phantom line portions of FIGS. 2 and 4. With housing 12 secured, as noted above, this single plane is substantially coplanar with the horizontal axis 42*a* depicted on target 42 in FIG. 5.

Figure 6:
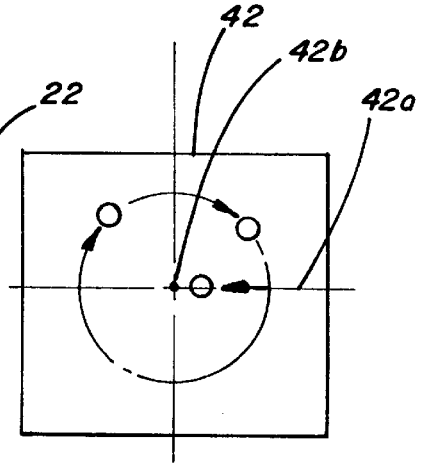
FIG. 6 is a plan view showing a pattern of laser beam contact against the target for use in aligning the laser module.

Laser module 14 is inserted into housing 12 until its front edge abuts location 12*b*, as depicted in FIGS. 2 and 5. Laser module 14 is energized using conventional techniques. A tool, inserted into notches 32*b* in the back-end of laser module housing 32, is used to rotate housing 32. As represented in FIG. 6, this causes a laser beam spot to hit target 42 and rotate as housing 32 rotates. When the laser beam spot intersects the horizontal axis 42*a* on target 42, rotation of laser module housing 32 is stopped. Still with reference to FIG. 6, laser module housing 32 is then moved (within the confines of the internal cavity of housing 12) in a linear sweeping motion until the laser beam spot intersects with the center 42*b* of target 42, indicating that laser module 14 is in the desired, aligned position.

An adhesive is applied to fix laser module 14 in the desired, aligned position. The adhesive may be applied through aperture 38 or through the back-end opening of housing 12. One or more spot welds may alternatively or additionally be implemented to fix the position of laser module 14 relative to housing 12. Also, an epoxy may be used to fill the void in between laser module 14 and the interior surface of housing 12.

To complete assembly of device 10, insulator 18 is inserted through the back-end opening in housing 12, and power supply 16 is likewise inserted. Back-end insulator 20 is screwed in place, as is back-end cap 22 with its associated spring 24. If a firearm 44 of caliber larger than that corresponding to device 10 is used, then an outer sleeve 56 of appropriate dimension is attached in any conventional manner to device 10.

In operation, device 10 is inserted into a chamber of firearm 44 where a round typically resides prior to firing, and firearm 44 is put into a "locked and loaded" condition. In this state, the firearm's bolt head, ejector, or like conductive parts will make physical and electrical contact in between backend cap 22 and housing 12, typically in proximity to location 12*d*. It should be noted that certain terminology may vary from one firearm to the next. For example, the names for internal components (e.g., bolt head or ejector) and states of operability (e.g., "locked and loaded") may be different for various firearms; however regardless of the terminology used, in some state of operation a conductive part of the subject firearm will make physical and electrical contact in between back-end cap 22 and housing 12.

In this condition, an electrical circuit is established including a conductive part of firearm 44 through which electrical current flows to energize laser module 14. Specifically and with reference to FIG. 2, one electrode of power supply 16 is electrically coupled through spring 26 to laser diode driver circuit 36. The other electrode of power supply 16 is electrically coupled to spring 24, back-end cap 22, the conductive part or parts of firearm 44, housing 12, and laser module housing 32 to laser diode 34 to complete the circuit. The conductive part or parts of firearm 44 may include a bolt head, an ejector, a barrel, or any other conductive part of firearm 44.

With the laser beam now emerging from a focused, aligned laser module 14, the user may put the laser beam spot on target 42, and then align the firearm's scope or sight 46 in a well known manner.

It should be understood that the methods and apparatuses described above are only exemplary and do not limit the scope of the invention, and that various modifications could be made by those skilled in the art that would fall under the scope of the invention. For example, while the method for aligning the laser module has been disclosed herein for use in aligning a firearm's scope, it is understood that the laser module alignment method is not limited to this field of use.

To apprise the public of the scope of this invention, the following claims are provided:

What is claimed:

1. A device facilitating adjustment of a sight of a firearm by providing a visible mark on a target when the device is placed within a chamber of the firearm, said device comprising:

a) a housing:

b) a laser module contained within the housing and being energizeable within the chamber to produce the mark at a position along a laser axis;

c) a power supply situated within the housing to energize the laser module when an electrically conductive flowpath is completed with the laser module; and d) an electrical circuit including at least the housing and a conductive part of the firearm through which electrical current flows to complete the flowpath.

2. The device of claim 1 further comprising an opening at each of two ends of the housing, one end permitting laser beam passage, and the other using a removable cap to contain the laser module and power supply within the housing.

3. The device of claim 1 wherein the housing has an external shape that substantially resembles an external shape of a round of appropriate caliber for shooting from the firearm.

4. The device of claim 1 wherein the housing includes an internal cavity which receives the laser module and restricts the laser module's range of motion to rotation of the module about the laser axis, and a sweeping motion of the module defining a locus of points along the laser axis which comprises a single plane.

5. The device of claim 2 further comprising at least one aperture through the housing to permit access to the laser module.

6. The device of claim 1 wherein an exterior surface of the device includes at least one non-conductive region, and at least one conductive region.

7. The device of claim 6 wherein the two regions are adjacent to one another on a portion of the device which resembles a casing of a round.

8. The device of claim 7 wherein a transition in between the two regions occurs in proximity to a base of the casing.

9. The device of claim 2 further including a non-conductive region in between the power supply and an interior surface of the housing.

10. A device facilitating adjustment of a sight of a firearm by providing a visible mark on a target when the device is placed within a chamber of the firearm, said device comprising:

a) a housing including an internal cavity;

b) a power supply; and c) a laser module with a range of motion restricted by the internal cavity to rotation of the module about a laser axis, and a sweeping motion of the module defining a locus of points along the laser axis which comprises a single plane.

11. The device of claim 10 further comprising at least one aperture through the housing to permit access to the laser module.

12. A method for energizing a laser module to produce a mark on a target, comprising:

a) positioning the laser module within a chamber of a firearm; and b) adjusting the firearm to complete an electrical circuit between a power supply and the laser module, wherein part of the firearm conducts current in between the power supply and the laser module.

13. The method of claim 12 further comprising readjusting the firearm to remove power supplied to the laser module.

14. A method of aligning a laser module having a laser axis, comprising:

a) providing a housing including an internal cavity dimensioned to restrict the laser module's range of motion to rotation of the laser module about the laser axis, and a sweeping motion of the laser module defining a locus of points along the laser axis which comprises a single plane;

b) inserting the laser module into the internal cavity;

c) supporting the housing containing the laser module;

d) energizing the laser module to produce a mark on a target;

e) holding the housing in place while rotating the laser module about the laser axis until the mark strikes an axis on the target that is coplanar with the single plane; and f) moving the laser module until the mark strikes a desired position.

15. The method of claim 14 further comprising focusing the laser module.

16. The method of claim 14 further comprising connecting the laser module to the housing after the mark is in the desired position.

17. The method of claim 14 wherein the laser module is permanently connected to the housing after the mark is in the desired position.

18. A device facilitating adjustment of a sight on each of a variety of firearm's having different calibers by providing a visible mark on a target when the device is placed within a chamber of any of the firearms, said device comprising:

a) a housing having an external shape sized to fit snugly within a chamber of predetermined caliber for one of the firearms;

b) a laser module energizeable within the housing to produce the mark at a position along a laser axis extending through the firearm's barrel;

c) a power supply situated within the housing to energize the laser module; and d) an outer sleeve fitting snugly around a portion of the housing, expanding the outer dimensions of the device to fit snugly within a larger caliber chamber of a different one of the firearms.

19. The device of claim 18 further including a plurality of outer sleeves, each when placed in turn around a portion of the housing, expanding the outer dimensions of the device differently to fit snugly within the chamber of a different caliber firearm.

20. A method of aligning a laser module having a laser axis, comprising:

a) providing a housing including an internal cavity;

b) inserting the laser module into the internal cavity;

c) supporting the housing containing the laser module;

d) energizing the laser module to produce a mark on a target;

e) holding the housing in place while rotating the laser module about the laser axis until the mark strikes an axis on the target that is coplanar with the single plane;

f) moving the laser module until the mark strikes a desired position; and g) permanently affixing the laser module to the housing.

* * * * *